US005377709A

United States Patent [19]

Shibano

[11] Patent Number: 5,377,709

[45] Date of Patent: Jan. 3, 1995

[54] ULTRASONIC VIBRATOR DEVICE FOR ULTRASONICALLY CLEANING WORKPIECE

[76] Inventor: Yoshihide Shibano, 1629-1-12, Oyama-cho, Machida-shi, Tokyo, Japan

[21] Appl. No.: 139,815

[22] Filed: Oct. 22, 1993

[30] Foreign Application Priority Data

Oct. 22, 1992 [JP] Japan ..... 4-073801[U]

[51] Int. Cl.[6] ..... B08B 3/12

[52] U.S. Cl. ..... 134/184; 134/1

[58] Field of Search ..... 134/1, 184, 186; 68/355; 366/127

[56] References Cited

U.S. PATENT DOCUMENTS 2,950,725 8/1960 Jacke et al. ..... 134/184

3,066,686 12/1962 O'Neill ..... 134/1 X 4,763,677 8/1988 Miller ..... 134/184 X

FOREIGN PATENT DOCUMENTS 4-46637 7/1992 Japan .

776669 11/1980 U.S.S.R. ..... 134/184

*Primary Examiner*—Philip R. Coe

*Attorney, Agent, or Firm*—Paul A. Guss

[57] ABSTRACT

A workpiece immersed in a cleaning solution in a cleaning tank is cleaned by ultrasonic energy radiated by an ultrasonic vibrator disposed in a sealed container in the cleaning tank. A fluid such as a coolant gas or liquid is introduced under pressure into the sealed container to pressurize the interior space of the sealed container to a pressure which is substantially equal to a static pressure that is applied to the cleaning solution in the cleaning tank.

13 Claims, 4 Drawing Sheets

ULTRASONIC VIBRATOR DEVICE FOR ULTRASONICALLY CLEANING WORKPIECE

BACKGROUND OF THE INVENTION

1. Field of the Invention

The present invention relates to an ultrasonic vibrator device for ultrasonically cleaning a workpiece, and more particularly to an ultrasonic vibrator device having ultrasonic vibrators which are to be placed in a deaerated cleaning solution sealed in a cleaning tank for applying ultrasonic energy to ultrasonically cleaning a workpiece put in the deaerated cleaning solution while the deaerated cleaning solution is being pressurized.

2. Description of the Prior Art

Heretofore, there have been known ultrasonic vibrators which are to be placed in a cleaning solution supplied to an ultrasonic cleaning tank. More specifically, the ultrasonic vibrators are held in a sealed container in the ultrasonic cleaning tank, and a voltage is applied to the ultrasonic vibrators to vibrate the ultrasonic vibrators for thereby radiating ultrasonic energy into the cleaning solution to clean a workpiece immersed in the cleaning solution. The sealed container is made of an SUS plate having a thickness of about 3 mm such that the ultrasonic energy can efficiently be radiated therethrough into the cleaning solution when the ultrasonic vibrators are vibrated. The surface of the sealed container where the ultrasonic vibrators are mounted is plated with a hard chromium layer having a thickness of 20 $\mu$m or greater in order to prevent the sealed container from being eroded by the cleaning solution.

When the ultrasonic energy is radiated from the ultrasonic vibrator into the cleaning solution, the cleaning solution is cavitated, and the workpiece is exposed to shock waves or microjets that are produced when the cavitation is collapsed. Foreign matter or burrs can be removed from the workpiece by those shock waves or microjets. For efficiently cleaning workpieces, it is necessary to provide conditions which facilitate the generation of the cavitation in the cleaning solution.

It is known that the cleaning solution can be cavitated more easily if the concentration of a gas dissolved in the cleaning solution is lower. If the concentration of a gas dissolved in the cleaning solution is too high, then the dissolved gas is converted into bubbles by the ultrasonic energy radiated by the ultrasonic vibrators, and the cleaning solution is less cavitated as the ultrasonic energy is absorbed by the bubbles. Therefore, when such bubbles are produced in the cleaning solution by the dissolved gas, the cleaning of the workpiece is essentially carried out only by the bubbles, but not by the ultrasonic energy.

The inventor has found out that the cleaning solution can more easily be cavitated when the cleaning solution is subjected to a suitable static pressure, and proposed an ultrasonic cleaning apparatus which applies a static pressure to a deaerated cleaning solution while a workpiece immersed in the deaerated cleaning solution is being ultrasonically cleaned (see Japanese patent publication No. 4-46637). The proposed ultrasonic cleaning apparatus has a sealing means for sealing a cleaning solution in a cleaning tank from the atmosphere, and a pressurizing means for applying a static pressure to the cleaning solution in the cleaning tank. Since the cleaning solution in the cleaning tank is sealed from the atmosphere, air finds difficulty in getting dissolved in the cleaning solution. The cleaning solution sealed in the cleaning tank can easily be held under a suitable static pressure by the pressurizing means. Therefore, the appropriate conditions for generating the cavitation in the cleaning solution are provided by the proposed ultrasonic cleaning apparatus.

However, though strong shock waves are produced upon collapse of the cavitation as the cavitation is easily developed, the wall surface of a sealed container housing the ultrasonic vibrator tends be strained by the static pressure applied thereto, causing the ultrasonic vibrators to be peeled off the surface of the sealed container. When the ultrasonic vibrators are peeled off, they fail to oscillate properly. The strained sealed container is apt to develop cracks in welded regions thereof, allowing the cleaning solution to enter the sealed container and causing a dielectric breakdown of the ultrasonic vibrators. The sealed container may be prevented from being strained by increasing the thickness of the wall thereof. However, the increased wall thickness hampers the transmission of vibrations from the ultrasonic vibrators, resulting in a reduction in the ultrasonic radiation efficiency.

SUMMARY OF THE INVENTION

It is therefore an object of the present invention to provide an ultrasonic vibrator device having ultrasonic vibrators which are safely placed in a pressurized cleaning solution in a cleaning tank without suffering an oscillation failure or a dielectric breakdown, and which can stably operate for ultrasonically cleaning a workpiece in the cleaning solution.

To achieve the above object, there is provided in accordance with the present invention an ultrasonic vibrator device for ultrasonically cleaning a workpiece, comprising a cleaning tank for sealingly storing a deaerated cleaning solution with a workpiece immersed therein, a sealed container disposed in the cleaning tank, an ultrasonic vibrator disposed in the sealed container for radiating ultrasonic energy into the cleaning solution in the cleaning tank, and pressurizing means for introducing a fluid under pressure into the sealed container to pressurize the interior space of the sealed container to a pressure substantially equal to the pressure in the cleaning tank.

When the cleaning solution in the cleaning tank is pressurized, a static pressure is applied to the cleaning solution. The static pressure is also applied to the sealed container which houses the ultrasonic vibrator. However, since the fluid is introduced under pressure into the sealed container to pressurize the interior space of the sealed container to the pressure substantially equal to the static pressure, the pressure in the sealed container counterbalances the static pressure in the cleaning tank. Therefore, the wall of the sealed container is prevented from being strained or distorted. The thickness of the wall of the sealed container is not required to be unduly increased. In addition, the ultrasonic vibrator is prevented from being peeled off the wall of the sealed container, and hence from suffering an oscillation failure. The sealed container is also prevented from developing cracks in welded regions thereof, and hence from causing the ultrasonic vibrator to be subjected to a dielectric breakdown.

The pressurizing means may comprise air pressurizing means for introducing a gas under pressure into the sealed container to pressurize the interior space of the sealed container. When the ultrasonic vibrator is continuously used for ultrasonically cleaning the workpiece, it is heated, gradually heating the cleaning solution up to an increased temperature. As the temperature of the cleaning solution rises, the cleaning solution is cavitated less efficiently. The ultrasonic vibrator device may further comprise cooling means for cooling the gas introduced under pressure into the sealed container to suppress heating of the ultrasonic vibrator to keep the cleaning solution at a temperature which allows the cleaning solution to be easily cavitated.

Alternatively, the pressurizing means may comprise liquid pressurizing means for introducing a liquid under pressure into the sealed container to pressurize the interior space of the sealed container. The ultrasonic vibrator device may further comprise cooling means for cooling the liquid introduced under pressure into the sealed container to suppress heating of the ultrasonic vibrator.

The liquid used in the liquid pressurizing means should preferably be a coolant having a high heat exchanging capability for cooling the ultrasonic vibrator. The coolant should not erode or break the dielectric strength of the sealed container or the ultrasonic vibrator.

The liquid pressurizing means may comprise liquid supply means for supplying the liquid to the sealed container, a sealed tank for storing the liquid independently of the sealed container, a liquid conduit interconnecting the sealed container and the sealed tank, and a pressurizing unit for pressurizing the liquid stored in the sealed tank to transmit the pressure through the liquid conduit to the liquid in the sealed container. The pressurizing unit may comprise an air compressor for introducing a gas into a space in the sealed tank to pressurize the liquid in the sealed tank, or alternatively a piston in the sealed tank as a cylinder for directly pressurizing the liquid in the sealed tank. The liquid supply means may include cooling means for cooling the liquid.

The ultrasonic vibrator device may further comprise a conduit for introducing the fluid under pressure into the sealed container, the sealed container and the pressurizing means being interconnected by the conduit. The conduit may have an externally threaded end extending through and threadedly fastened to a wall of the sealed container. The conduit is thus securely attached to the sealed container against detachment due to the static pressure or shock waves that are developed upon collapse of the cavitation in the cleaning solution.

A conductive cable which electrically connects the ultrasonic vibrator to an external ultrasonic oscillator may extend through the conduit. With the conductive cable extending through the conduit, the cleaning tank which is used as a pressure container is not required to have an independent hole in its wall for passing the conductive cable, and hence has its mechanical strength kept at a desired level.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
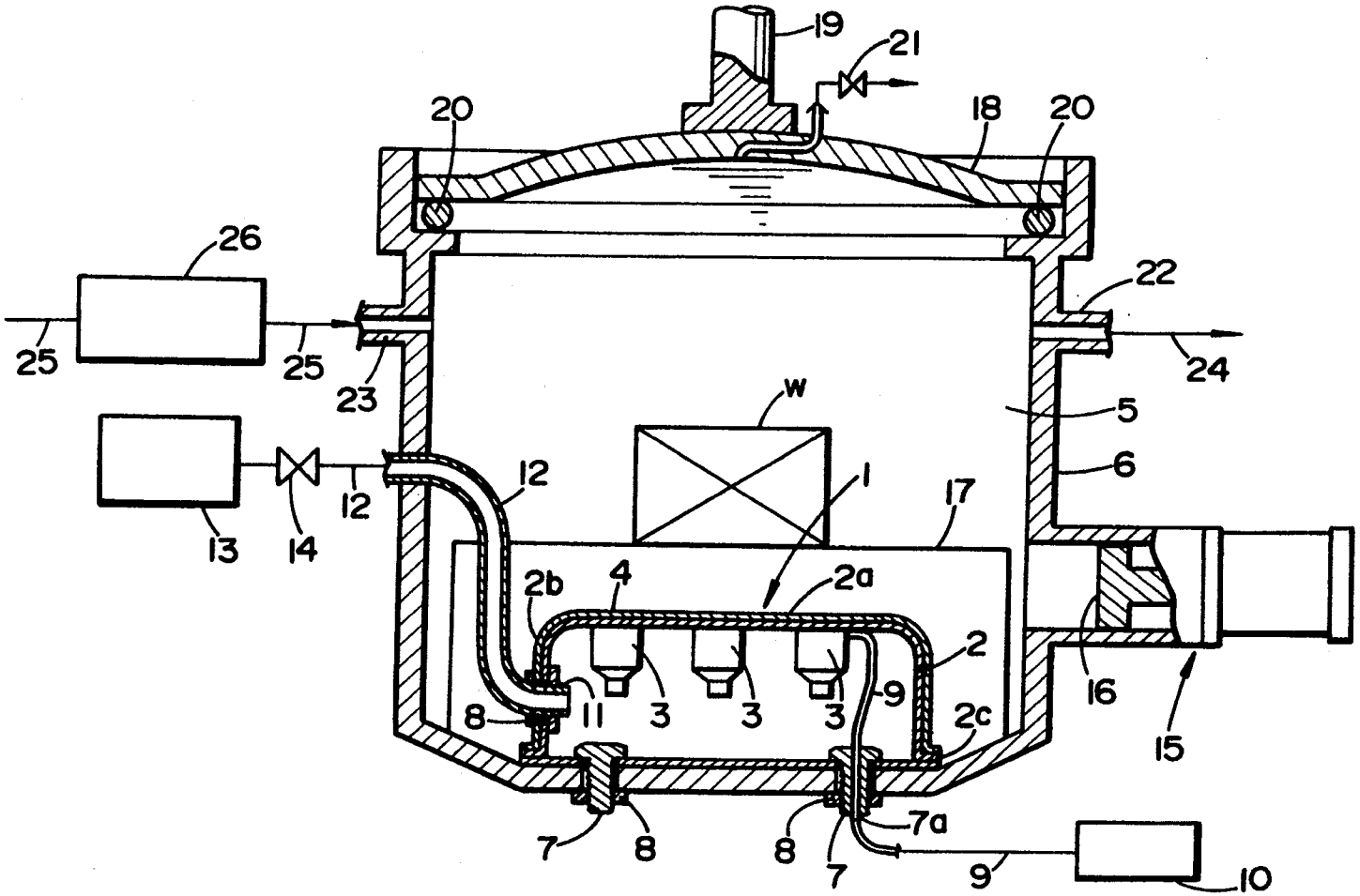
FIG. 1 is a cross-sectional view of an ultrasonic cleaning apparatus incorporating an ultrasonic vibrator vice according to an embodiment of the present invention.

As shown in FIG. 1, an ultrasonic vibrator device 1 according to an embodiment of the present invention has a sealed container 2 and a plurality of ultrasonic vibrators 3 disposed in the sealed container 2. The ultrasonic vibrators 3 are mounted on an upper wall 2*a* of the sealed container 2. The sealed container 2 is made of an SUS plate having a thickness of 3 mm, and its outer surface is plated with a hard chromium layer 4 having a thickness of 20 μm. The sealed container 2 is fastened by bolts 7 and nuts 8 to the bottom of an ultrasonic cleaning tank 6 which is supplied with a cleaning solution 5. The ultrasonic vibrators 3 are electrically connected to an external ultrasonic oscillator 10 by a conductive cable 9 which is hermetically inserted through a hole 7*a* axially defined in one of the bolts 7.

The sealed container 2 has a side wall 2*b* into which an externally threaded end portion 11 of an air supply conduit 12 is inserted, the externally threaded end portion 11 being fastened to the side wall 2*b* by a nut 8. The air supply conduit 12 is connected to an air compressor 13 which supplies air under pressure into the sealed container 2. The air compressor 13 is placed outside of the ultrasonic cleaning tank 6 and connected to the air supply conduit 12 through a vent valve 14.

A pressurizing cylinder 15 is mounted on a side wall of the ultrasonic cleaning tank 6. The pressurizing cylinder 15 has a piston 16 for applying a static pressure to the cleaning solution 5 in the ultrasonic cleaning tank 6. The ultrasonic cleaning tank 6 houses a table 17 mounted on the bottom thereof for supplying a workpiece W thereon above the ultrasonic vibrator device 1. The table 17 may be made of any of various materials which can transmit ultrasonic energy therethrough. Preferably, the table 17 is in the form of a thin plate of SUS or a cage of rough mesh of SUS.

A lid 18 for sealing the cleaning solution 5 in the ultrasonic cleaning tank 6 from contact with the atmosphere is vertically movably disposed on the upper open end of the ultrasonic cleaning tank 6 and supported by a sealing cylinder piston 19. When the lid 18 is lowered, it is pressed against the circumferential edge of the upper open end of the ultrasonic cleaning tank 6 through an annular gasket 20. The lid 18 has an air bleeder valve 21.

The ultrasonic cleaning tank 6 has a cleaning solution outlet port 22 and a cleaning solution inlet port 23 which are defined in confronting side walls thereof and connected respectively to a cleaning solution discharge conduit 24 and a cleaning solution supply conduit 25. The cleaning solution supply conduit 25 is coupled to a deaerating means 26 for deaerating the cleaning solution 5 before it is supplied to the ultrasonic cleaning tank 6. The cleaning solution discharge conduit 24 and the cleaning solution supply conduit 25 are connected to a cleaning solution reservoir (not shown) so that the cleaning solution 5 can circulate through the cleaning solution discharge conduit 24, the ultrasonic cleaning tank 6, the cleaning solution reservoir, and the cleaning solution supply conduit 25.

Operation of the ultrasonic vibrator device 1 shown in FIG. 1 will be described below.

The cleaning solution 5 which is deaerated by the deaerating means 26 is supplied through the cleaning solution supply conduit 25 and the cleaning solution inlet port 23 into the ultrasonic cleaning tank 6, and the workpiece W is placed onto the table 14 by a lifter means (not shown) and immersed in the cleaning solution 5 in the ultrasonic cleaning tank 6. Thereafter, the lid 18 is lowered by the sealing cylinder piston 19 until it is pressed against the upper open end of the ultrasonic cleaning tank 6, thereby sealing the interior space of the ultrasonic cleaning tank 6. The deaerated cleaning solution 5 is further supplied to the ultrasonic cleaning tank 6 until the ultrasonic cleaning tank 6 sealed by the lid 18 is filled up with the cleaning solution 5. At this time, any remaining air above the cleaning solution 5 escapes through the air bleeder valve 21, and hence no air remains in the ultrasonic cleaning tank 6 sealed by the lid 18.

Then, the piston 16 of the pressurizing cylinder 15 is actuated to apply a static pressure to the cleaning solution 5 in the ultrasonic cleaning tank 6, and the ultrasonic vibrators 3 are energized to radiate ultrasonic energy into the ultrasonic solution 5 for thereby cleaning the workpiece W immersed therein. Since the cleaning solution 5 is deaerated and subjected to the static pressure, it can easily be cavitated, and foreign matter and burrs on the workpiece W can easily be removed by shock waves that are developed when the cavitation is collapsed.

The static pressure applied to the cleaning solution 5 by the piston 16 should preferably be of about 5 kg/cm$^2$ in order to allow the cleaning solution 5 to be easily cavitated. When the static pressure of that magnitude is applied, if the upper wall 2*a* of the sealed container 2 on which the ultrasonic vibrators 3 are mounted has a size of about 20 cm×30 cm, then the pressure applied to the upper wall 2*a* reaches 3,000 kg. According to the present invention, air is supplied under pressure from the air compressor 13 through the air supply conduit 12 into the sealed container 2 to pressurize the air in the sealed container 2 up to a pressure which is substantially equal to the static pressure in the ultrasonic cleaning tank 6. The air pressure in the sealed container 2 and the static pressure in the ultrasonic cleaning tank 6 are therefore balanced, preventing the sealed container 2 from being deformed. Consequently, the ultrasonic vibrators 3 are prevented from being peeled off the upper wall 2*a* of the sealed container 2, and/or welded regions 2*c* of the sealed container 2 are prevented from developing cracks. The ultrasonic vibrators 3 can thus radiate desired ultrasonic energy into the cleaning solution 5.

After the workpiece W has been cleaned, the piston 16 returns to its home position, and the cleaning solution 5 is discharged from the cleaning solution outlet port 22 to the cleaning solution reservoir, and the air bleeder valve 21 is opened to introduce air into the ultrasonic cleaning tank 6. As a result, the level of the cleaning solution 5 in the ultrasonic cleaning tank 6 is lowered, and the pressure in the ultrasonic cleaning tank 6 is reduced to the normal pressure. At the same time, the vent valve 14 on the air supply conduit 12 is opened to discharge the air from the sealed container 2, reducing the pressure in the sealed container 2 to the normal pressure.

The lid 18 is lifted, and the cleaned workpiece W is taken out of the ultrasonic cleaning tank 6 by the lifter means.

As described above, the sealed container 2 is fastened by the bolts 7 and the nuts 8 to the bottom of the ultrasonic cleaning tank 6, and one of the bolts 7 has the hole 7*a* through which the conductive cable 9 interconnecting the ultrasonic vibrators 3 to the external ultrasonic oscillator is hermetically inserted.

Figure 2:
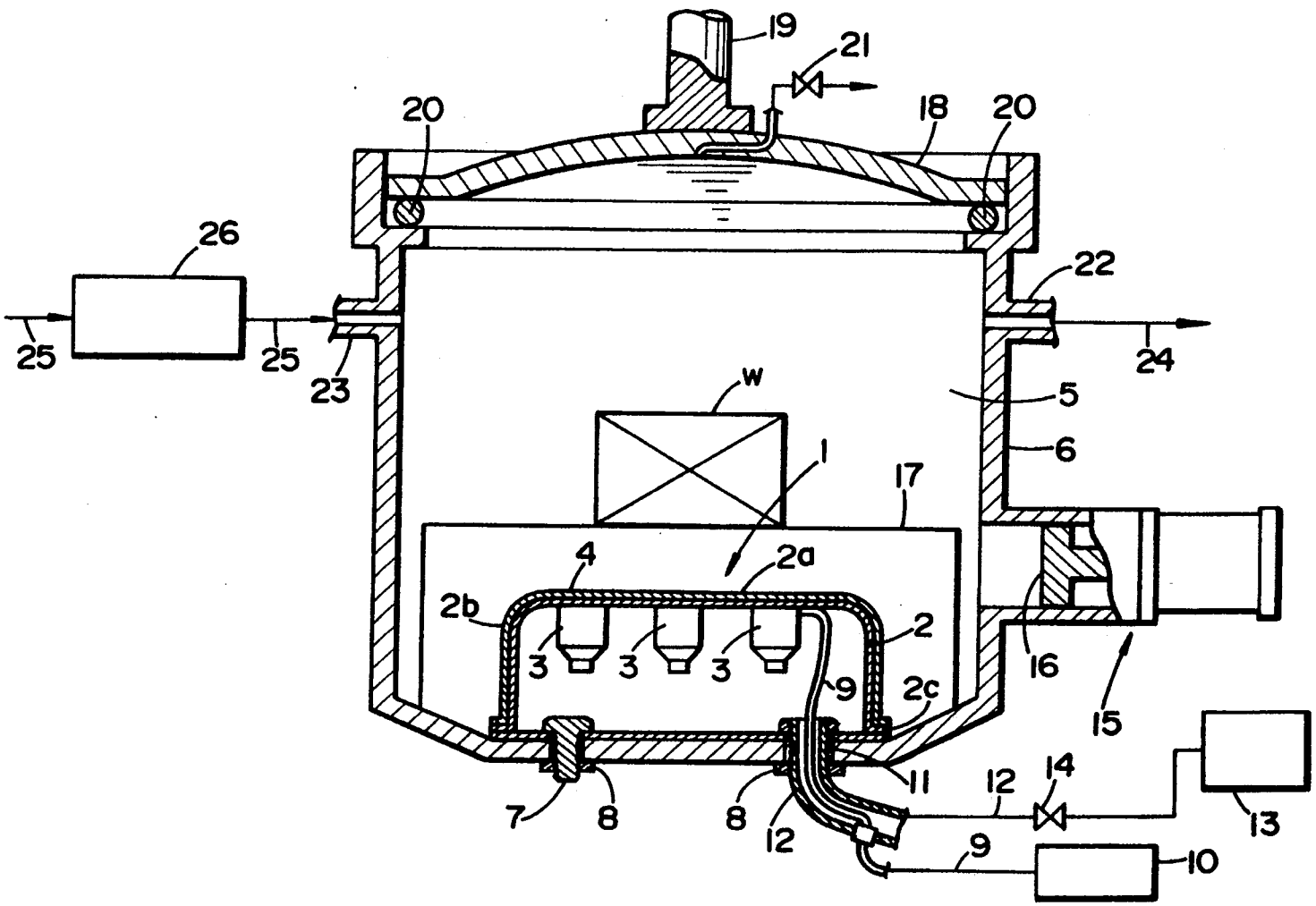
FIG. 2 is a cross-sectional view of an ultrasonic cleaning apparatus incorporating an ultrasonic vibrator device according to another embodiment of the present invention.

However, as shown in FIG. 2, the air supply conduit 12 may enter the sealing container 2 through the hole 7*a*. In such an arrangement, the conductive cable 9 is inserted through the air supply conduit 12 into the sealed container 2, and also extends out of the air supply conduit 12 through a suitable means while keeping the air supply conduit 12 hermetically sealed, and is connected to the external ultrasonic oscillator 10.

The ultrasonic vibrator device 1 shown in FIGS. 2 operates in the same manner as the ultrasonic vibrator device 1 shown in FIG. 1.

When the ultrasonic vibrators 3 shown in FIGS. 1 and 2 are continuously energized to ultrasonically clean the workpiece W, they are heated, and hence the cleaning solution 5 is gradually heated up to an increased temperature. As the temperature of the cleaning solution 5 rises, the cleaning solution 5 tends to be less subjected to cavitation when the ultrasonic energy is radiated into the cleaning solution 5. Therefore, when air is introduced under pressure into the sealed container 2, such air should preferably have been cooled.

Figure 3:
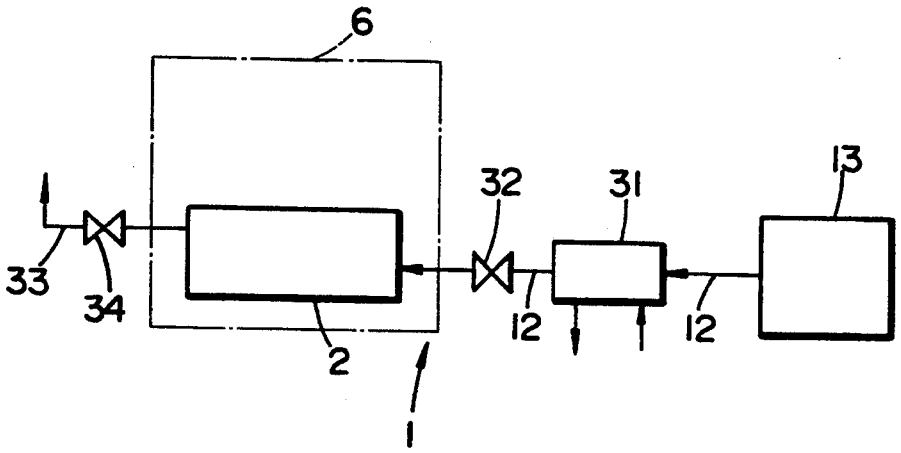
FIG. 3 is a schematic view of an ultrasonic vibrator device according to still another embodiment of the present invention, the ultrasonic vibrator device having a system for pressurizing the interior space of a sealed container with a coolant gas.

To cool the air that is supplied under pressure into the sealed container 2, as shown in FIG. 3, an air cooling unit 31 is connected to the air supply conduit 12, which is connected through a solenoid-operated valve 32 to the sealing container 2. The sealed container 2 is connected to an air discharge conduit 33 with a vented end through a pressure regulator valve 34. The pressure regulator valve 34 operates in ganged relationship to the solenoid-operated valve 32 such that the pressure in the sealed container 2 is substantially equal to the static pressure in the ultrasonic cleaning tank 6. The sealing container 2 and the ultrasonic cleaning tank 6 shown in FIG. 3 are identical in structure to those shown in FIGS. 1 and 2, and will not be described in detail below.

The air cooling unit 31 may comprise a device in which a coolant liquid passes outside of the air supply conduit 12 to cool the air in the air supply conduit 12. The air supply conduit 12 and the air discharge conduit 33 may be threadedly connected to the side wall of the sealing container 2 as shown in FIG. 1, or the conductive cable 9 may be inserted through the air supply conduit 12 as shown in FIG. 2.

The ultrasonic vibrator device 1 shown in FIG. 3 operates as follows:

When a static pressure is applied to the cleaning solution 5 in the ultrasonic cleaning tank 6, air is supplied under pressure from the air compressor 13 through the air supply conduit 12 into the sealed container 2. At this time, the air is intermittently introduced into the sealed container 2 by the solenoid-operated valve 32, and the air pressure in the sealed container 2 is controlled by the pressure regulator valve 34 so as to be substantially equal to the static pressure in the ultrasonic cleaning tank 6. The air that is warmed when the ultrasonic vibrators 3 are cooled is discharged from the sealed container 2 through the air discharge conduit 33 when the pressure regulator valve 34 is opened, and the sealed container 2 is supplied with cooled air from the air cooling unit 31 through the solenoid-operated valve 32. Therefore, the interior space of the sealing container 2 is maintained in a cooled atmosphere at all times, thus preventing the temperature of the cleaning solution 5 from increasing with the heat of the ultrasonic vibrators 3.

Figure 4:
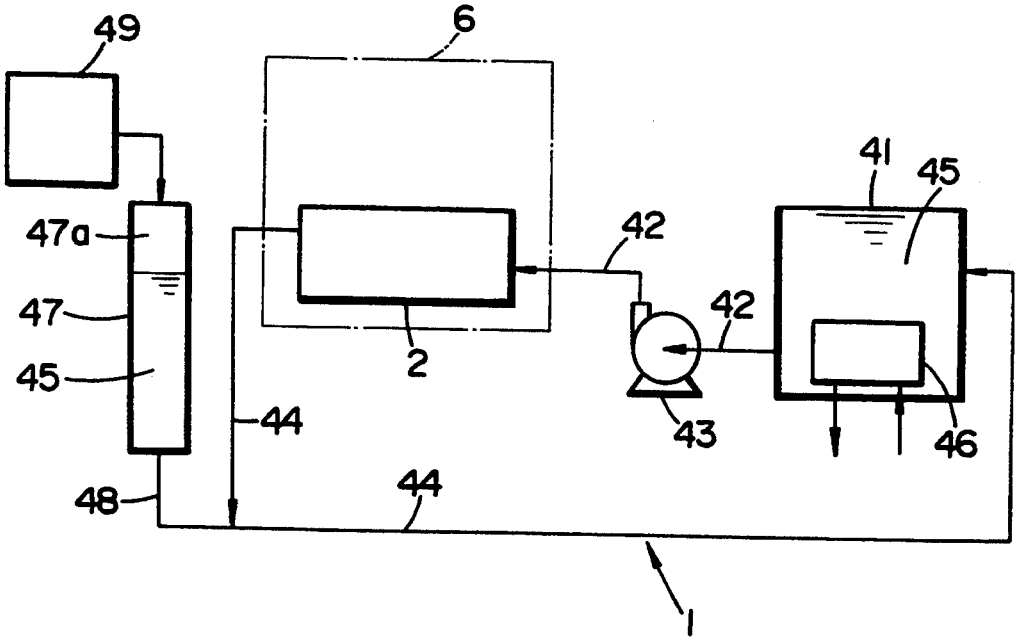
FIG. 4 is a schematic view of an ultrasonic vibrator device according to yet another embodiment of the present invention, the ultrasonic vibrator device having a system for pressurizing the interior space of a sealed container with a coolant liquid.

In the above embodiments, the interior space of the sealed container 2 is pressurized by air supplied under pressure. However, the interior space of the sealed container 2 may be pressurized by a liquid supplied under pressure. An ultrasonic vibrator device 1 with a liquid pressuring means is illustrated in FIG. 4. The sealing container 2 and the ultrasonic cleaning tank 6 shown in FIG. 4 are identical in structure to those shown in FIGS. 1 and 2, and will not be described in detail below.

As shown in FIG. 4, the ultrasonic vibrator device 1 has a sealed coolant reservoir 41 disposed outside of the ultrasonic cleaning tank 6, and the coolant reservoir 41 and the sealed container 2 are interconnected by a coolant supply conduit 42 having a supply pump 43. A coolant discharge conduit 44 has one end connected to the sealed container 2 and the other end to the coolant reservoir 41. Therefore, a coolant 45 in the form of a liquid stored in the coolant reservoir 41 is supplied to the sealed container 2 by the supply pump 43, and then circulates back to the coolant reservoir 41. The coolant reservoir 41 houses a cooling unit 46 for keeping the circulating coolant 45 at a constant temperature.

A sealed tank 47 which also stores the coolant 45 is disposed outside of the sealed container 2, and connected to the coolant reservoir 41 by a coolant conduit 48. The sealed tank 47 has a space 47*a* above the coolant 45 stored therein. The sealed tank 47 is connected to an air compressor 49 as a pressurizing unit which supplies air under pressure into the space 47*a* to pressurize the coolant 45 in the sealed tank 47 for transmitting the pressure through the coolant conduit 48 to the coolant 45 in the sealed container 2.

Operation of the ultrasonic vibrator device 1 shown in FIG. 4 will be described below.

The coolant 45 in the coolant reservoir 41 is supplied to the sealed container 2 through the coolant supply conduit 42 by the supply pump 43, and deprives the ultrasonic vibrators 3 of heat, after which the coolant 45 is discharged from the sealed container 2 through the coolant discharge conduit 44 back to the coolant reservoir 41. The coolant 45 remains cooled at all times by the cooling unit 46 in the coolant reservoir 41.

When the static pressure is applied to the cleaning solution 5 in the same manner as the ultrasonic vibrator device 1 shown in FIG. 1, air is introduced under pressure from the air compressor 49 into the space 47*a* in the sealed tank 47, pressurizing the coolant 45 in the sealed tank 47. The pressure imposed on the coolant 45 is transmitted through the coolant conduit 48 to the sealed container 2. As a consequence, the coolant 45 supplied to the sealed container 2 is pressurized to a pressure which is substantially the same as the static pressure in the ultrasonic cleaning tank 6.

Inasmuch as the interior space of the sealed container 2 is pressurized by the coolant 45, the ultrasonic vibrators 3 can efficiently be cooled, thereby preventing the temperature of the cleaning solution from rising due to the heat of the ultrasonic vibrators 3. The coolant 45 should have a high heat exchanging capability and should not erode or breaks the dielectric strength of the sealed container 2 and the ultrasonic vibrators 3. Preferably, the coolant 45 should be a fluorine inert liquid composed of a highly fluorinated hydrocarbon, e.g., "Fluorinert" (trademark) manufactured by Sumitomo 3M Co. Ltd.

Figure 5:
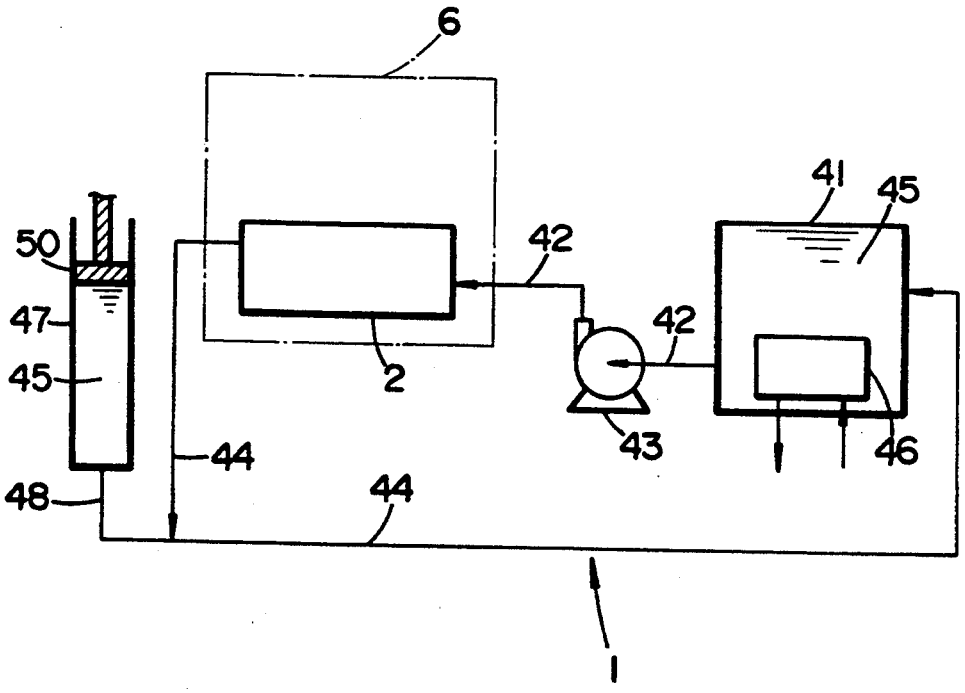
FIG. 5 is a schematic view of an ultrasonic vibrator device according to yet still another embodiment of the present invention, the ultrasonic vibrator device having another system for pressurizing the interior space of a sealed container with a coolant liquid.

In the ultrasonic vibrator device 1 shown in FIG. 4, air is introduced under pressure from the air compressor 49 into the space 47*a* above the coolant 45 in the sealed tank 47 in order to pressurize the coolant 45 therein. However, as shown in FIG. 5, the sealed tank 47 may be in the form of a cylinder having a piston 50, and the coolant 45 in the sealed tank 47 may be pressurized directly by the piston 50. The cooling unit 46 may be connected to the coolant discharge conduit 44. The coolant supply conduit 42 and the coolant discharge conduit 44 may be threadedly connected to the side wall of the sealed container 2 as shown in FIG. 1, or the conductive cable 9 may be inserted through the air supply conduit 12 as shown in FIG. 2.

Although certain preferred embodiments of the present invention has been shown and described in detail, it should be understood that various changes and modifications may be made therein without departing from the scope of the appended claims.

What is claimed is:

1. An ultrasonic vibrator device for ultrasonically cleaning a workpiece, comprising:

a cleaning tank for sealingly storing a deaerated cleaning solution with a workpiece immersed therein;

a sealed container disposed in said cleaning tank;

an ultrasonic vibrator disposed in said sealed container for radiating ultrasonic energy into the cleaning solution in said cleaning tank; and pressurizing means for introducing a fluid under pressure into said sealed container to pressurize the interior space of said sealed container to a pressure substantially equal to the pressure in said cleaning tank.

2. An ultrasonic vibrator device according to claim 1, wherein said pressurizing means comprises air pressurizing means for introducing a gas under pressure into said sealed container to pressurize the interior space of said sealed container.

3. An ultrasonic vibrator device according to claim 2, further comprising cooling means for cooling the gas introduced under pressure into said sealed container.

4. An ultrasonic vibrator device according to claim 1, wherein said pressurizing means comprises liquid pressurizing means for introducing a liquid under pressure into said sealed container to pressurize the interior space of said sealed container.

5. An ultrasonic vibrator device according to claim 4, further comprising cooling means for cooling the liquid introduced under pressure into said sealed container.

6. An ultrasonic vibrator device according to claim 4, wherein said liquid comprises a coolant.

7. An ultrasonic vibrator device according to claim 4, wherein said liquid pressurizing means comprises:

liquid supply means for supplying the liquid to said sealed container;

a sealed tank for storing the liquid independently of said sealed container;

a liquid conduit interconnecting said sealed container and said sealed tank; and a pressurizing unit for pressurizing the liquid stored in said sealed tank to transmit the pressure through said liquid conduit to the liquid in said sealed container.

8. An ultrasonic vibrator device according to claim 7, wherein said pressurizing unit comprises a gas pressurizing unit for introducing a gas under pressure into a space in said sealed tank to pressurize the liquid stored in said sealed tank.

9. An ultrasonic vibrator device according to claim 7, wherein said pressurizing unit comprises a piston disposed in said sealed tank as a cylinder for directly pressurizing the liquid stored in said sealed tank.

10. An ultrasonic vibrator device according to claim 7, wherein said liquid supply means includes cooling means for cooling said liquid.

11. An ultrasonic vibrator device according to claim 1, further comprising a conduit for introducing the fluid under pressure into said sealed container, said sealed container and said pressurizing means being interconnected by said conduit.

12. An ultrasonic vibrator device according to claim 11, wherein said conduit has an externally threaded end extending through and threadedly fastened to a wall of said sealed container.

13. An ultrasonic vibrator device according to claim 11, further comprising a conductive cable extending through said conduit for electrically connecting said ultrasonic vibrator to an external ultrasonic oscillator.

* * * * *